United States Patent [19]

Creek

[11] Patent Number: 4,467,488

[45] Date of Patent: Aug. 28, 1984

[54] DEVICE FOR FINAL CLEANING OF TUBES

[75] Inventor: Ronald B. Creek, Chattanooga, Tenn.

[73] Assignee: Combustion Engineering, Inc., Windsor, Conn.

[21] Appl. No.: 452,550

[22] Filed: Dec. 23, 1982

[51] Int. Cl.[3] ..... B08B 9/04

[52] U.S. Cl. ..... 15/3.5; 15/104.06 A

[58] Field of Search ..... 15/3.5, 3.51, 104.06 A; 254/134.3 R; 134/8; 239/114, 116; 165/95

[56] References Cited

U.S. PATENT DOCUMENTS

| | | | |
|---|---|---|---|
| 2,915,422 | 12/1959 | Stone | 15/104.06 A |
| 3,631,555 | 1/1972 | Hurst et al. | 15/3.5 |
| 4,252,255 | 2/1981 | Henderson | 15/3.5 X |

*Primary Examiner*—Edward L. Roberts
*Attorney, Agent, or Firm*—Robert L. Olson

[57] ABSTRACT

An apparatus for inserting cleaning plugs into the ends of tubes to be cleaned including a tool, a handle on the tool capable of being held by an operator, a chamber having an open end capable of being aligned with the open end of the tube to be cleaned, a first ram opposite the open end, a first piston-cylinder capable of moving the ram through the chamber and retracting it therefrom thereby forcing a cleaning plug into the tube, a magazine opening laterally from the first ram and open end into the chamber, a second ram positioned so as to move cleaning plugs from the magazine into the chamber, a second piston-cylinder capable of moving the second ram through and retracting it from the magazine, a housing for a chain of cleaning plugs, the housing opening into the magazine, a gas source maintaining a constant pressure on the chain of cleaning plugs so as to force a cleaning plug into the chamber when nothing else occupies it, and a trigger on the handle which in a first position pressurizes the second piston-cylinder, and in a second position pressurizes the first piston-cylinder.

4 Claims, 1 Drawing Figure

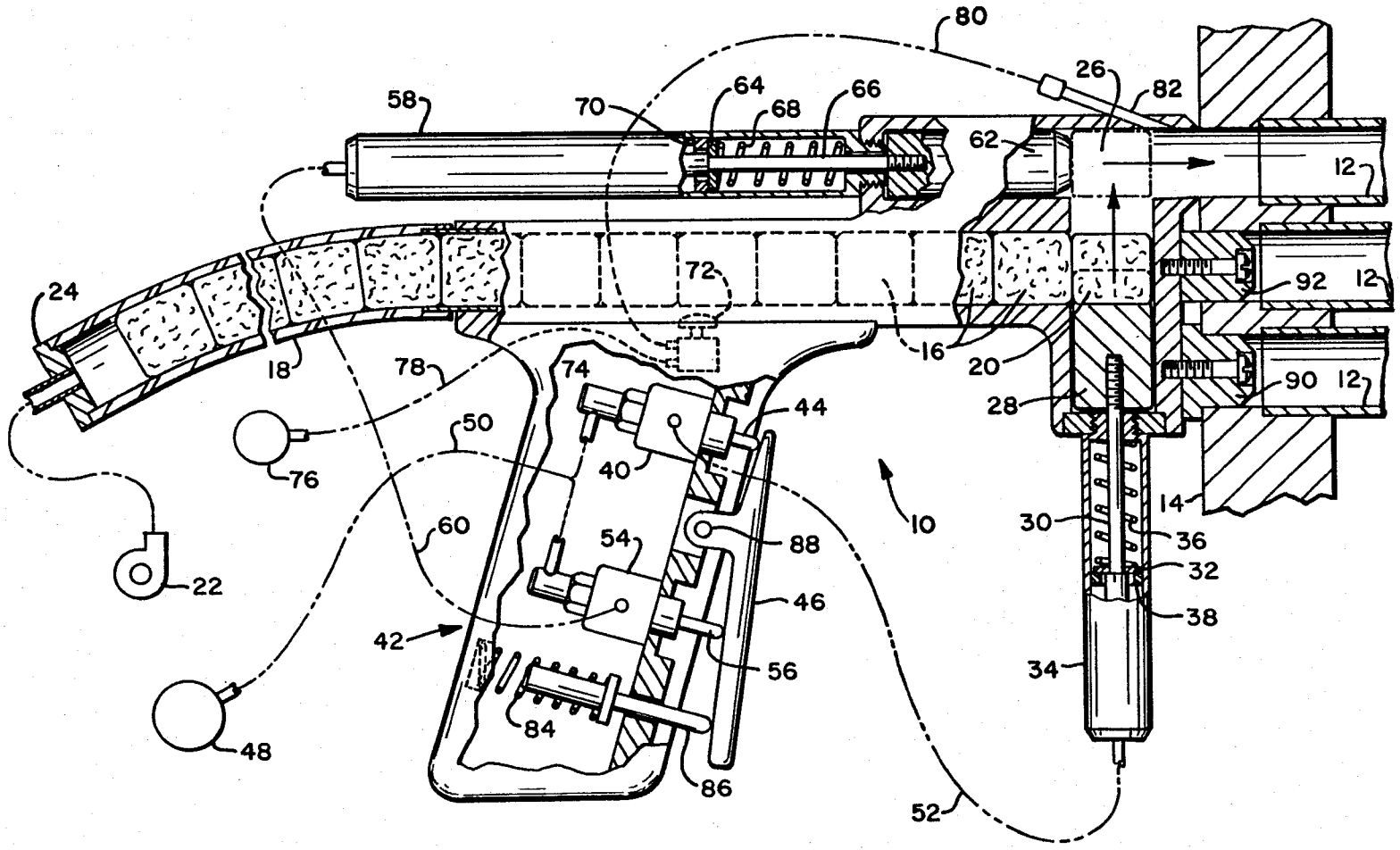
12
12
12
92
90
14
36
32
38
82
26
30
34
28
20
62
80
16
10
52
66
44
88
46
56
68
64
72
86
40
54
70
74
84
50
60
58
78
42
18
76
48
22
24

DEVICE FOR FINAL CLEANING OF TUBES

BACKGROUND OF THE INVENTION

In nuclear steam generators, great care is taken to maintain all of the equipment in a fairly clean state. This includes cleaning the inside of the heat exchange tubes before the unit is initially started up, and also periodically during regularly scheduled maintenance shutdowns. The tubes are generally cleaned by inserting and forcing felt plugs through each tube. Usually a plug wetted with a cleaning agent, such as isopropyl alcohol, is forced through, followed by a number of dry plugs. Since there are many tubes in each steam generator (upwards of 10,000), and the tubes are rather small in diameter ($\frac{5}{8}$ of an inch ID), the cleaning is a long and tedious job. The present invention is directed to apparatus by means of which workers can quickly and easily load felt plugs (either dry or wetted with a cleaning agent) into the tubes of a nuclear steam generator so that they can be forced therethrough by a pressurized inert gas.

SUMMARY OF THE INVENTION

In accordance with the invention, apparatus in the form of a tool or gun which can be hand-held by a worker is provided by a means of which cleaning plugs can be inserted into the open ends of steam generating tubes. A button or trigger on the handle of the tool permits isopropyl alcohol to be discharged into the tube being cleaned when desired. A second trigger on the handle is used to actuate sequential valves which moves a plug from the magazine to the firing chamber, and thence into the tube to be cleaned. High pressure gas is used as the actuating means. A pair of pins on the front of the tool are used to accurately align the tool or gun with the tube to be cleaned.

BRIEF DESCRIPTION OF THE DRAWING

The FIGURE is a cross-sectional side view of a gun or tool used to insert cleaning plugs into the ends of steam generating tubes.

DESCRIPTION OF THE PREFERRED EMBODIMENT

Looking now to the FIGURE, numeral 10 designates a tool or gun in its entirety which can be used to insert felt plugs into steam generating tubes 12 for cleaning them. The steam generating tubes 12 are usually U-shaped, and are attached to a tube sheet 14 at both of their ends. A typical nuclear steam generator has thousands of such U-shaped tubes, the interior of which must be cleaned. A plurality of felt plugs 16 are contained in a flexible tube 18, and are forced into magazine 20 by a constant low pressure gas source 22 acting on the end of the plugs.

The plug 16 contained in magazine 20 is forced into chamber 26 by means of ramrod 28, which is secured to a piston rod 30 and piston 32. High pressure air is admitted to cylinder 34 behind the piston 32 when a plug is to be moved into chamber 26. Spring 36 moves the piston back to its original position in contact with stop member 38 when the pressure on piston 32 is released. Pressure is supplied to and released from cylinder 34 by means of 3-way valve 40 contained in the handle 42 of the gun or tool 10. When valve stem 44 is depressed by trigger 46, high pressure gas from a source 48 and a line 50 is supplied to cylinder 34 through line 52. When the trigger 46 is released, 3-way valve 40 opens line 52 to the atmosphere.

After a felt plug has been placed into chamber 20, trigger 46 is actuated so as to open the 3-way valve 54 by depressing valve stem 56, allowing high pressure gas from source 48 to enter the cylinder 58 through line 60. This actuates ram 62 through piston 64 and rod 66, forcing a plug into the tube 12. When the pressure is released from cylinder 58 through 3-way valve 54, spring 68 returns piston 64 to its original position against stop 70.

When it is desired to add isopropyl alcohol to one of the cleaning plugs 16, button or trigger 72 on the handle 42 is depressed, which opens valve 74, permitting flow of the cleaning agent from a pressurized source 76 through line 78, valve 74 and line 80 into nozzle 82, which discharges into the front part of chamber 26. When a plug is to be wetted, the button 72 is actuated, forcing alcohol through the nozzle 82 into chamber 26 and tube 12, and then stuffing the plug in behind the alcohol.

Spring 84 and plunger 86 on the handle 42 is only for the purpose of maintaining the trigger 46 in a neutral position, and to act as a stop when trigger 46 is pivoted clockwise about pivot 88. The spring biasing the valve 40 to its closed position is stronger than spring 84. Thus, both 3-way valves 40 and 54 are normally in their closed position; i.e., with their respective cylinders 34 and 58 open to the atmosphere and not connected to the high pressure gas source 48. A pair of pins 90 and 92 are fit into adjacent tubes so that the chamber 26 is properly aligned with the tube a felt plug is being inserted into. These pins have tapered ends for ease of entry into tubes 12.

The operation of the gun or tool 10 will now be described. A worker will hold the tool 10 by its handle 42 and bring the forward end into engagement with the tube sheet 14 with pins 90 and 92 extending into two of the tubes 12. Chamber 26 is thus firmly aligned with a third tube 12. If a saturated plug is desired, button 72 is depressed, forcing alcohol into the forward end of chamber 26 and the tube 12. Trigger 46 is thereafter pivoted in a counterclockwise direction about pivot point 88, opening 3-way valve 40, so that high pressure gas flows to cylinder 34, moving ram 28 upwardly, forcing a felt plug 16 into the chamber 26. The trigger 46 is then rotated clockwise about pivot point 88. This releases the pressure in cylinder 34 to the atmosphere, withdrawing plunger or ram 28 to its original position and causing another felt plug to enter the magazine 20. It also opens valve 54, causing high pressure gas to enter cylinder 58, moving ram 62 to the right, forcing the felt plug into the open end of the tube 12. As many plugs can be placed in as many of the tubes as desired by the use of the tool 10, and then another tool can be used to blow the plugs through the tubes by means of pressurized inert gas.

I claim:

1. In combination, apparatus for inserting cleaning plugs into the ends of tubes to be cleaned including a tool, handle means on the tool capable of being held by an operator, chamber means having an open end capable of being aligned with the open end of a tube to be cleaned, a first ram opposite the open end, a first piston-cylinder capable of moving the ram through the chamber means and retracting it therefrom thereby forcing a cleaning plug into the tube, a magazine opening laterally from the first ram and open end into the chamber means, a second ram positioned so as to move cleaning plugs from the magazine into the chamber means, a second piston-cylinder capable of moving the second ram through and retracting it from the magazine, means housing a chain of cleaning plugs, the means opening into the magazine, means maintaining a constant pressure on the chain of cleaning plugs so as to force a cleaning plug into the chamber when nothing else occupies it, and trigger means on the handle means which in a first position pressurizes the second piston-cylinder, and in a second position pressurizes the first piston-cylinder.

2. The combination set forth in claim 1, including a pair of pins on the tool capable of being inserted into a pair of tubes so as to positively align the chamber means with the open end of a tube to be cleaned.

3. The combination set forth in claim 2, wherein the pins are tapered to aid in the insertion thereof into the tubes.

4. The combination set forth in claim 3, including a second trigger on the handle means, which when actuated, forces cleaning fluid into the open end of the chamber means.

* * * * *